US009724658B2

(12) United States Patent
Post et al.

(10) Patent No.: US 9,724,658 B2
(45) Date of Patent: Aug. 8, 2017

(54) METHOD OF HOMOGENIZING A LIQUID

(75) Inventors: Johannes Hermanus Nicolaas Post, Sassenheim (NL); Bob Honsbeek, Oegstgeest (NL); Goran Aleksijovski, Noordwijk (NL)

(73) Assignee: Fast & Fluid Management B.V., Sassenheim (NL)

( * ) Notice: Subject to any disclaimer, the term of this patent is extended or adjusted under 35 U.S.C. 154(b) by 370 days.

(21) Appl. No.: 13/073,297

(22) Filed: Mar. 28, 2011

(65) Prior Publication Data

US 2012/0250451 A1 Oct. 4, 2012

(51) Int. Cl.

| | |
|---|---|
| ***B01F 11/00*** | (2006.01) |
| ***B01F 5/02*** | (2006.01) |
| ***B01F 5/10*** | (2006.01) |
| ***B01F 13/10*** | (2006.01) |
| ***B01F 15/00*** | (2006.01) |
| *B01F 3/00* | (2006.01) |

(52) U.S. Cl.

CPC ..... *B01F 11/0074* (2013.01); *B01F 5/0206* (2013.01); *B01F 5/10* (2013.01); *B01F 13/1058* (2013.01); *B01F 15/0085* (2013.01); *B01F 15/00831* (2013.01); *B01F 2003/0028* (2013.01)

(58) Field of Classification Search

CPC ..... B01F 5/10; B01F 11/0074
USPC ..... 366/132, 137
See application file for complete search history.

(56) References Cited

U.S. PATENT DOCUMENTS

| | | | | |
|---|---|---|---|---|
| 5,052,813 | A | 10/1991 | Latto | |
| 2004/0057334 | A1* | 3/2004 | Wilmer et al. | 366/136 |
| 2006/0114744 | A1* | 6/2006 | White et al. | 366/101 |
| 2010/0080077 | A1* | 4/2010 | Coy | 366/137 |
| 2012/0034258 | A1* | 2/2012 | Herron-Olson et al. | C07K 14/31 424/190.1 |

FOREIGN PATENT DOCUMENTS

| | | | |
|---|---|---|---|
| DE | 15 57 197 | A1 | 3/1970 |
| EP | 0800858 | A1 | 10/1997 |
| EP | 1492970 | A1 | 1/2005 |
| EP | 1 688 652 | A1 | 8/2006 |
| EP | 1 813 653 | A1 | 8/2007 |
| EP | 1 908 510 | A2 | 4/2008 |
| EP | 2 198 950 | A1 | 12/2008 |
| FR | 1 366 894 | A | 7/1964 |
| FR | 1366894 | * | 7/1964 |
| GB | 1004721 | | 9/1965 |
| GB | 2 333 047 | A | 7/1999 |
| WO | 01/17668 | A1 | 3/2001 |
| WO | 2008/110606 | A1 | 9/2008 |

OTHER PUBLICATIONS

Machine translation of FR1366894, provided by esp@cenet, retrieved Feb. 21, 2013.*

International Search Report and Written Opinion for corresponding PCT Application No. PCT/EP2012/055488, report dated Sep. 18, 2013.

* cited by examiner

*Primary Examiner* — Abbas Rashid

(74) *Attorney, Agent, or Firm* — Miller, Matthias & Hull LLP

(57) ABSTRACT

Method of homogenizing a liquid, in particular a colorant for paint, in a container, comprising the steps of withdrawing liquid from the container at a first flow speed (S1) and then returning the liquid to the container at a second flow speed (S2), higher than the first flow speed (S1).

10 Claims, 2 Drawing Sheets

METHOD OF HOMOGENIZING A LIQUID

BACKGROUND

Technical Field

The invention relates to a method of homogenizing a liquid, in particular a colorant for paint, in a container. The invention further relates to an assembly for dispensing a liquid comprising a container and a pump and to an apparatus comprising a plurality of such assemblies.

Background of the Related Art

Brownian motion of particles suspended in liquids is not sufficient to overcome gravitational forces and such particles tend to settle out of the liquid and agglomerate. The paint industry has struggled with this problem for more than a hundred years. It is still widely believed within this industry that in order for a pigmented colorant to be successfully applied using colorant dispensers the dispersion must be stirred. This requirement places stringent demands on the manufacturers of dispensers, especially when colorants contain a high loading of pigment.

EP 2 198 950 relates to an apparatus (denoted by numeral 1 in the Figures of that publication) for dispensing a plurality of fluids, comprising a support, such as a turntable (2) or a linear table, a plurality of containers (4) for holding a fluid mounted on the support (2), pumps (3) connected to respective containers (4), a common actuator (31) for sequentially operating the pumps (3), stirring elements mounted rotatably inside and extending from the containers (4), and a drive mechanism (21) for rotating the stirring elements, wherein the support (2) on the one hand and the actuator (31) and drive mechanism (21) on the other are movable relative to each other. The drive mechanism (21) comprises a protrusion (26) movable between at least a first, extended position (FIG. 2B) for engaging a stirring element (20) and a second, retracted position (FIG. 2A).

WO 2008/110606 relates to a canister assembly comprising an annular outer shell (21) with an outer cylindrical wall connected to a bottom which, in turn, is connected to an inner cylindrical wall that serves as a standpipe. The bottom includes an outlet (29) connected to a pump. A hollow agitator shaft (21) slides over the inner standpipe and includes a plurality of outwardly extending blades (32) for stirring or "agitating" the fluid.

EP 1 908 510 relates to a device for mixing fluids, particularly paints and varnishes. The Figures of this publication shows a storage tank (2) containing a stirring element. GB 1,004,721 also discloses stirring devices.

In practice, stirrers get contaminated, the colorants will dry in, and over time a buildup of thin layers of colorant will form on the stirrers. The dried layers can be a serious cause of contamination when pieces of the layers break away and drop in the colorant. This might even cause blocking of a downstream pump or contamination of the paint.

Another disadvantage is that stirrers inevitably cause a lot of interaction between the colorant and the atmosphere above the colorant, resulting in evaporation of solvent and in oxidation.

It is an object of the present invention to provide a method of homogenizing a liquid, in particular a colorant for paint, in a container, that does not require a stirrer.

SUMMARY OF THE DISCLOSURE

The invention relates to a method of homogenizing a liquid, in particular a colorant for paint, in a container, comprising the steps of withdrawing liquid from the container at a first flow speed (S1) and then returning the liquid to the container at a second flow speed (S2), higher than the first flow speed (S1).

These measures were found to result in effective mixing, even without the use a stirrer. In an embodiment, part, preferably most of the liquid is returned in a direction having an axial component, preferably returned along the central axis of the container.

In a further embodiment the second flow speed (S2) is in excess of $0.2\ A*(V^{1/2})/M$, where M is the percentage of the volume of the liquid withdrawn relative to the maximum volume of the container, V is the percentage of the height of the column of the liquid in the container (before withdrawing) relative to the height of the container, and A is a correction for viscosity and in range of 0.6 to 1.4, preferably in a range from 0.8 to 1.2. In yet another embodiment, an amount of at least 5% preferably at least 10% of the content of the container is withdrawn from and returned to the container, typically no more than 50% of the content of the container.

Further, the liquid is preferably returned at a pressure in a range from 2 to 10 bar, more specifically 3 to 8 bar, more specifically 4 to 6 bar.

By adjusting the flow speed to the viscosity of the colorant in such a way that a pulse flow is created at the exit of the conduit connecting the container to a pump, the colorant will flow upwards trough the centre of the container and reach the top portion of the liquid in the container. To avoid that the returned colorant will break through the colorant surface in the container, the pump stroke and pump speed can be adjusted to the actual colorant level and colorant specification (density, viscosity, reologic structure, etc.).

To efficiently homogenize the whole contents of the container, it is preferred to withdraw liquid from the lower half, preferably the bottom portion of the liquid in the container and return it to the upper half, preferably the top portion of the liquid in the container.

Another embodiment comprises consecutively repeating the steps of withdrawing liquid from the container and then returning the liquid to the container until a volume corresponding to at least 50%, preferably at least 70% of the liquid in the container has been withdrawn and returned. This procedure can be carried out e.g. between dispensing paint recipes or when the dispenser has been idle for a pre-selected period, e.g. six hours.

To compensate for variations in viscosity resulting from, e.g., variations in temperature, in an embodiment, the method comprises establishing, e.g. measuring, calculating or retrieving from a database, the viscosity of the liquid in the container and adjusting the first and/or second flow speeds depending on the viscosity.

The invention further relates to an assembly for dispensing a liquid comprising a container for holding a liquid, a pump connected to the container via at least one conduit and a controller for operating the pump, wherein the controller is arranged to operate the pump to withdraw liquid from the container at a first flow speed (S1) and then return the liquid to the container at a second flow speed (S2), higher than the first flow speed (S1).

In an embodiment, the conduit is oriented in a direction having a component extending along the central axis of the container, i.e. an axial component, and preferably extends coaxial with the central axis of the container.

In another embodiment no stirrer is present in the container.

The invention further relates to an apparatus for dispensing a plurality of liquids, in particular colorants for paint, comprising a plurality of assemblies in accordance with the invention as described above.

Within the framework of the present invention the term "liquid" is defined as any flowable material that comprises a liquid phase and thus includes suspensions and emulsions. Colorants often contain high density pigments or particles suspended in (instable) liquid binder/solvent solutions.

BRIEF DESCRIPTION OF THE DRAWINGS

The disclosed method, assembly, and apparatus will be further explained with reference to the accompanying drawings in which presently preferred embodiments of the invention are shown schematically.

It is noted that the drawings are not necessarily to scale and that details, which are not necessary for understanding the present invention, may have been omitted.

DETAILED DESCRIPTION OF THE PRESENTLY PREFERRED EMBODIMENTS

Figure 1:
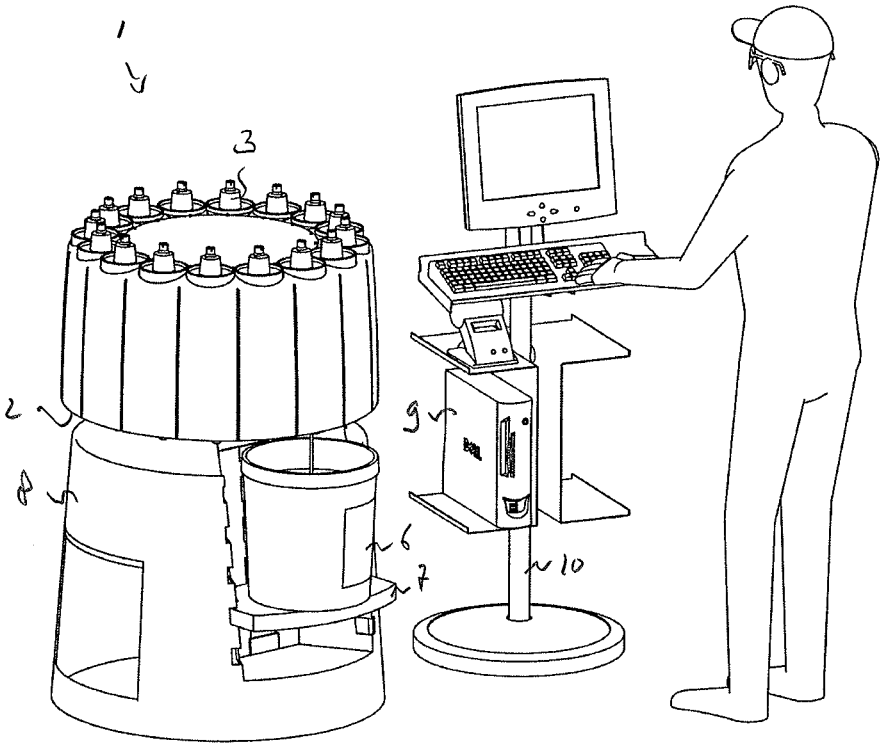
FIG. 1 is a perspective view of a disclosed apparatus for dispensing liquids.

FIG. 1 shows an example of an apparatus 1 for dispensing a plurality of liquids, such as colorants for paints, but also hair dyes, shampoos, foundations, and the like. It can be used for dispensing numerous recipes and formulas of the said products and it can be located e.g. at a retailer of decorative paints.

This particular dispensing apparatus 1 is an automated version and includes a horizontal turntable 2, with a plurality of containers 3 mounted along its circumference. Each container 3 is provided with a pump 4 and a valve 5 (FIGS. 2A to 5).

The turntable 2 can be rotated between discrete positions, e.g. twelve or sixteen positions including a dispensing position, i.e. a position where the pumps and valves are operated by means of a central actuator. Liquids are dispensed in a receptacle, in this example a bucket 6 on an adjustable shelf 7. The apparatus 1 includes a base 8 made e.g. by injection moulding a polymer. A computer 9 for entering and storing information, such as customer data and recipes, and generating instructions for driving the turntable 2, pumps and valves, is positioned on a separate stand 10.

Further information regarding suitable turntables and procedures for driving the various components, are disclosed in, for instance, European patent applications EP 800 858, EP 1 492 970, EP 1 688 652, and EP 2 198 950.

As shown in FIGS. 2A to 5, each valve 5 is connected by means of a conduit 11 to the bottom of a container 3, to a positive displacement pump 4, and to a dispense opening or dispense conduit 12. In this example, the pump 4 comprises a cylinder 13 and a piston and piston rod 14 slidably accommodated inside the cylinder 13. Further, the valve 5 comprises an operating element, e.g. a handle, lever, or, in this example, a rotary knob 15. The valve 5 and rotary knob 15 provide three positions, a first or closed position wherein both the outlet opening and the connection between the container and the pump are closed, a second or intake position wherein the connection between the container and the pump is open and the outlet is closed, and a third or dispense position wherein the connection between the container and the pump is closed and the outlet is open.

Figure 2A:
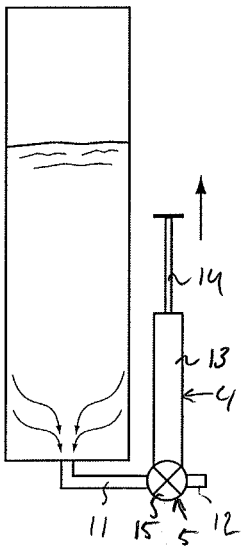
FIGS. 2A to 2C are cross-sections of an assembly comprising a container and a pump and illustrate a sequence of events in accordance with the present invention.
Figure 2B:
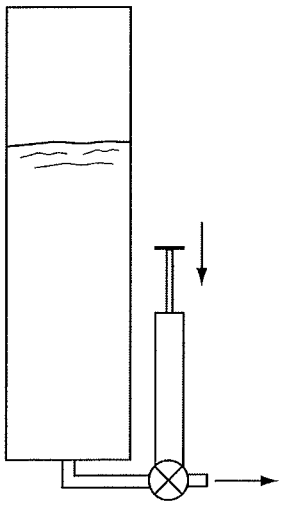
Figure 2C:
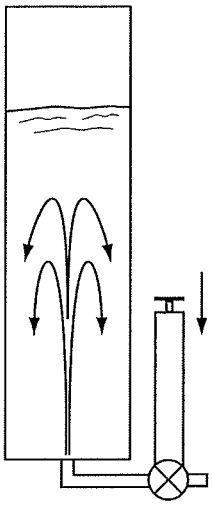

An example of the method of the present invention is illustrated in FIGS. 2A and 2C. In a first step (FIG. 2A), the valve is in its second or intake position and the piston is pulled out, thus withdrawing liquid from the container at a first speed, S1. If the liquid is to be dispensed (FIG. 2B), the valve is rotated to its dispense position and the piston is pushed in. If (part of) the liquid is to used for homogenizing the contents of the container, the valve remains at (or is returned to) the second position and the piston is pushed in at a higher speed thus injecting the liquid back into the container at a second speed, S2, higher than the first speed.

In FIG. 2C, the second speed is selected such that the major part of the returned liquid reached the middle part of the container. However, to homogenize the whole contents of the container, it is preferred to withdraw the liquid from the bottom of the container and return it to the upper half, preferably the top portion of the liquid in the container.

Figure 3:
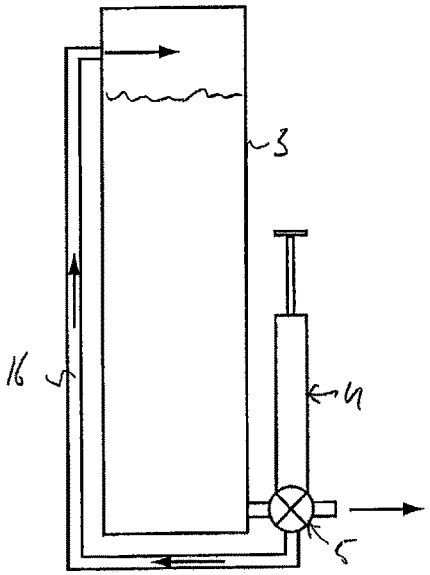
FIGS. 3 to 5 show further embodiments of the assembly according to the present invention.

Homogenization can be further enhanced in various ways. FIG. 3 shows an embodiment of an assembly of a container and pump in accordance with the present invention, comprising an additional (internal or external) conduit 16 connecting the valve 5 and pump 4 to the top part of the container 3 to deliver the returned liquid directly to the top portion of the container 3.

Figure 4:
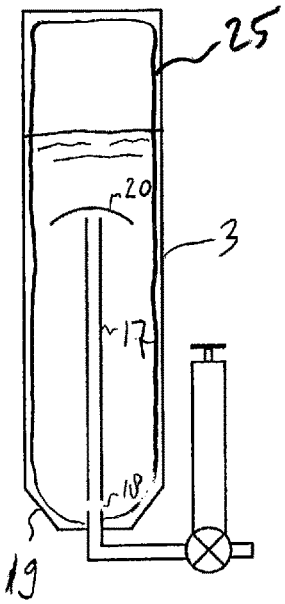

FIG. 4 shows an embodiment comprising a central riser or pipe 17, with one or more openings 18 in its wall near the bottom of the container 3, which may include an inner flexible container 25. Further, the bottom portion 19 of the container 3 is frustoconical, has a smaller diameter than the rest of the container and/or comprises other means to increase flow resistance for liquid flowing out of the openings. The flow resistance generated by these means and the flow resistance in the pipe are balanced to ensure that during the withdrawing of the liquid from the container at a first, relatively low speed S1, most liquid will be withdrawn from the bottom portion of the liquid in the container and that during the returning of the liquid from the container at a second, relatively high speed S2, most liquid will be expelled from the top opening in the pipe, i.e. at the top portion of the liquid in the container.

The assembly shown in FIG. 4 further comprises a cover 20 for the top opening of the pipe. This cover will prevent a 'fountain' inside the container if the liquid is returned at too high a speed. Also, if the container is provided with a flexible bag (not shown) holding the liquid—e.g. to prevent interaction between the liquid and any air in the container—, the cover prevents blocking of the top opening in the pipe by the flexible bag.

Figure 5:
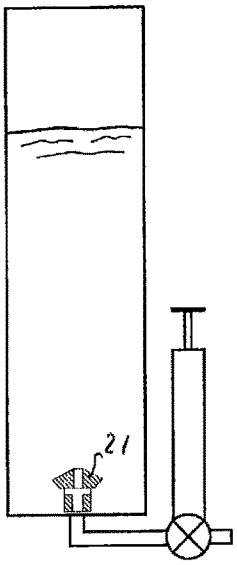
Figure 6A:
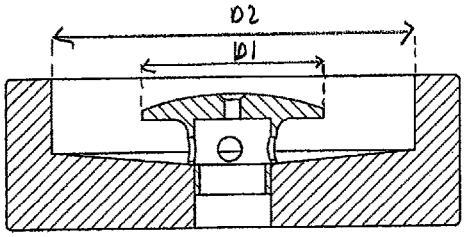
FIGS. 6A and 6B are cross-sections of a nozzle used in the embodiment shown in FIG. 5.
Figure 6B:
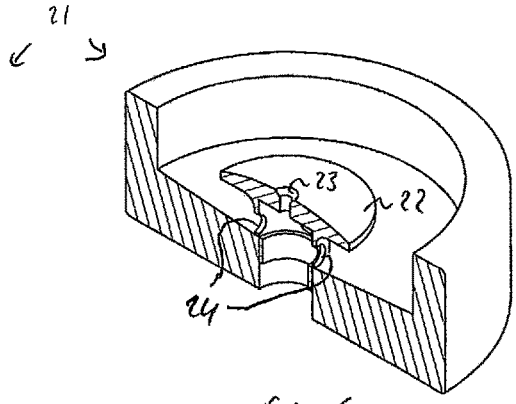

FIG. 5 shows an embodiment comprising another example of a structure 21 for increasing mixing efficiency. The structure 21, shown in more detail in FIGS. 6A and 6B, comprises a top surface 22 provided with a central opening 23 and a plurality of radial openings 24.

The area and length of the central opening on the one hand and the area and length of the radial opening, the diameter, D1, of the top surface, and the inner diameter, D2, of the container at the axial position of the structure, on the other hand, have been selected to increase the amount of liquid that is directed in axial direction during the returning of the liquid at the second speed.

In general, good results were obtained with structures that fulfil the following criterion:

$$(D2^2-D1^2)/D1=C/\pi$$

where D1 and D2 are the diameters defined above and C is in a range from 3 to 300. In the example shown in FIGS. 6A and 6B, C equals 24.

The method and assembly of the present invention provide efficacious homogenization of colorants in containers, obviating the need for a stirrer.

As a matter of course, the invention is not restricted to the above-disclosed embodiment and can be varied in numerous ways within the scope of the claims. E.g., the container can made of a rigid material or of a flexible material. Flexibility of the container and/or a bag inside the container enables the container to compensate for the amount of liquid that is withdrawn temporarily.

What is claimed:

1. A method of homogenizing a liquid in a container, comprising:

providing an initial liquid in the container;

providing a reciprocating positive displacement pump connected to the container, the pump reciprocating between intake strokes for withdrawing at least some of the initial liquid from the container and delivering said at least some of the initial liquid to the pump and output strokes that either return said at least some of the initial liquid to the container or dispense said at least some the initial liquid;

in a withdrawal step, withdrawing a first part of the initial liquid from the container at a first flow speed (S1) and delivering said first part of the initial liquid to the pump during at least one intake stroke of the pump, said first part of the initial liquid being less than 50% of the initial liquid in the container;

in a return step, returning said first part of the initial liquid from the pump to back the container at a second flow speed (S2) during at least one output stroke of the pump, wherein the second flow speed (S2) is greater than the first flow speed (S1); and wherein the withdrawal step and the return step are carried out alternatingly.

2. The method according to claim 1, wherein said first part of the initial liquid is returned to the container along a central axis of the container.

3. The method according to claim 1, wherein said first part of the initial liquid is at least 5% of the initial liquid.

4. The method according to claim 1, wherein said first part of the initial liquid is withdrawn from a lower half of the container and said first part of the initial liquid is returned to an upper half of the container.

5. The method according to claim 1, further comprising:

consecutively repeating withdrawing said first part of the initial liquid from the container followed by returning said first part of the initial liquid to the container until a volume corresponding to at least 50% of the initial liquid in the container has been withdrawn from the container and returned to the container.

6. The method according to claim 1, further comprising:

establishing a level of the initial liquid in the container or a level of the initial liquid less any liquid that has been dispensed; and adjusting the second flow speed depending on the level of initial liquid or the level of the initial liquid less any liquid that has been dispensed in the container.

7. The method according to claim 1, further comprising:

establishing a viscosity of the initial liquid in the container; and adjusting at least one of the first and second flow speeds depending on the viscosity.

8. The method of claim 1, wherein said first part of the initial liquid is returned at a pressure in a range from 2 to 10 bar.

9. The method of claim 1, wherein said first part of the initial liquid is returned at a pressure in a range from 3 to 8 bar.

10. The method of claim 1, wherein said first part of the initial liquid is returned at a pressure in a range from 4 to 6 bar.

* * * * *